US008743034B2

(12) United States Patent
Ryu

(10) Patent No.: US 8,743,034 B2
(45) Date of Patent: Jun. 3, 2014

(54) ARRAY SUBSTRATE OF LIQUID CRYSTAL DISPLAY DEVICE AND METHOD OF DRIVING THE SAME

(75) Inventor: Bongyeol Ryu, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 1026 days.

(21) Appl. No.: 12/420,196

(22) Filed: Apr. 8, 2009

(65) Prior Publication Data

US 2009/0256787 A1 Oct. 15, 2009

(30) Foreign Application Priority Data

Apr. 15, 2008 (CN) ..... 2008 1 0104116

(51) Int. Cl.
*G09G 3/36* (2006.01)

(52) U.S. Cl.
USPC ..... 345/87; 349/40

(58) Field of Classification Search
None
See application file for complete search history.

(56) References Cited

U.S. PATENT DOCUMENTS

| | | | | |
|---|---|---|---|---|
| 6,104,449 | A * | 8/2000 | Takahashi et al. | 349/40 |
| 7,375,724 | B2 * | 5/2008 | Jiang et al. | 345/204 |
| 2008/0259009 | A1 * | 10/2008 | Gao | 345/87 |

* cited by examiner

*Primary Examiner* — Jason Olson
(74) *Attorney, Agent, or Firm* — Ladas & Parry LLP

(57) ABSTRACT

An array substrate of a liquid crystal display (LCD) device comprising a switching device switching a connection between a short ring connected with a common line and each of a plurality of data lines. The switching device is turned off during a normal state, but is turned on by a control signal when the LCD device is turned off, thereby making an electrical potential of the data lines to be equal to that of the short ring.

4 Claims, 2 Drawing Sheets

ARRAY SUBSTRATE OF LIQUID CRYSTAL DISPLAY DEVICE AND METHOD OF DRIVING THE SAME

BACKGROUND

Embodiments of the present invention relate to an array substrate of a liquid crystal display (LCD) device and a method of driving the same.

LCD devices have become one important type of flat panel display devices, and mainly comprise a substrate array, a color filter substrate, a timing controller providing signals for the substrate array, and etc. LCD devices display images by making use of the principle that liquid crystal sandwiched between the array substrate and the color filter substrate can be aligned in accordance with applied electrical field across the liquid crystal layer.

In a conventional LCD device, when the LCD device is suddenly turned off, the output of a timing controller (T-con) may continue for some time, and the residual signal generated during the time may be input into pixels via a thin film transistor (TFT) as a switching device. If the LCD device is turned on before the residual signal has been completely released, the LCD device may directly display images without initialization, and thus after image may appear.

In addition, some conventional LCD devices are provided with a short ring (SR) in the non-display region of the display panel in order to prevent electronic elements from being broken down by static electricity built up during fabricating processes. Given that there are N data lines on the panel, the SR is provided with N diodes for transmitting electrostatic charges to each of the data lines, and each of the data lines is provided with one diode for transmitting electrostatic charges to the SR. When static electricity is generated on any one of the data lines, the electrostatic charges can be transmitted through the SR to other data lines with the diodes, so that all the data lines can release the electrostatic charges simultaneously and thus the electrostatic breakdown of electronic elements can be prevented.

SUMMARY

According to an embodiment of the invention, there is provided an array substrate of a liquid crystal display (LCD) device comprising a switching device switching a connection between a short ring connected with a common line and each of a plurality of data lines. The switching device is turned off during a normal state, but is turned on by a control signal when the LCD device is turned off, thereby making potential of the data lines to be equal to that of the short ring.

According to an embodiment of the invention, there is provided a method of driving an array substrate of a liquid crystal display (LCD) device, which comprises a short ring connected with a common line and a plurality of data lines, wherein a switching device is disposed between each of the data lines and the short ring and is controlled by a compensating line. The method comprises the step of supplying the compensating line with a high level signal to turn on the switching device when the LCD device is turned off. After the switching device is turned on, the short ring connected to the common line is electrically connected to the data lines, and potential of pixel electrodes of pixels connected to the data lines is made to be equal to that of the common line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the following detailed description.

BRIEF DESCRIPTION OF THE DRAWINGS

The present invention will become more fully understood from the detailed description given hereinafter and the accompanying drawings which are given by way of illustration only, and thus are not limitative of the present invention and wherein.

DETAILED DESCRIPTION OF THE EMBODIMENTS

Figure 1:
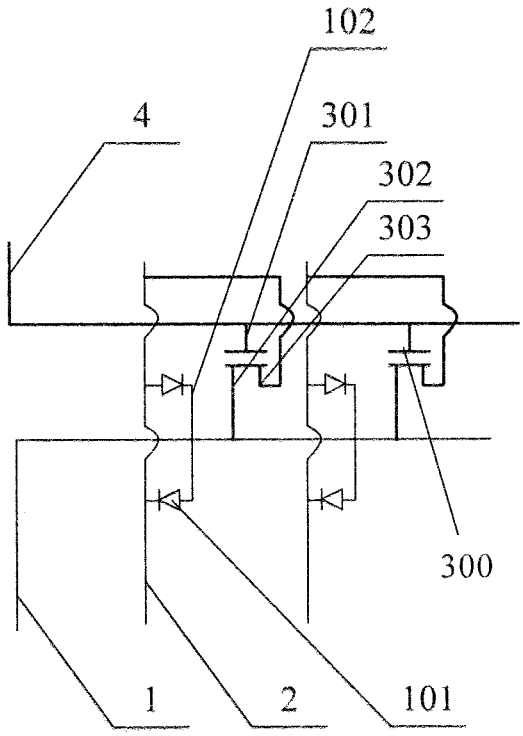
FIG. 1 is a schematic structural view of a first embodiment of the invention.

FIG. 1 is a schematic structural view of a first embodiment of the present invention, and as shown in FIG. 1, a LCD device according to the first embodiment mainly comprises a short ring 1 that is supplied with a common voltage and a plurality of data lines 2. A switching device is disposed between each of the data lines 2 and the short ring 1 for switching the connection the between the respective data line 2 and the short ring 1 and transmitting the common voltage of the short ring 1 to the respective data line 2 when the display device is turned off.

In the first embodiment of the present invention, the LCD device releases charge in pixel units by applying the common voltage supplied to the short ring to the data lines when the LCD device is turned off, and thus the LCD device can prevent after images from appearing when the LCD device is suddenly turned off and the display quality of the LCD device can be improved.

In the first embodiment of the present invention, a thin film transistor (TFT) 300 is provided as an example of the switching device for switching the connection between the short ring and the respective date lines. A gate electrode 301 of the TFT 300 is connected to a compensating line 4 that supplies a high level signal when the LCD device is turned off, a source electrode 302 of the TFT 300 is connected to the short ring 1 that is supplied with the common voltage, and a drain electrode 303 of the TFT 300 is connected to the respective data line 2. With the above configuration, the TFT 300 is turned on by a high level signal supplied through the compensating line 4 when the LCD device is turned off, such that the common voltage of the short ring can be transmitted from the source electrode 302 of the TFT 300 to the drain electrode 303 of the TFT 300, thus the pixel electrodes of all the pixel units connected to the data lines 2 can be supplied with the common voltage and the all the pixel electrodes are at the same potential. At this time, in the each pixel unit of the LCD device, a common voltage is applied to a common electrode of the pixel unit, and also a common voltage supplied to the pixel electrode of the pixel unit, so that the capacitance between the common electrode and the pixel electrode is eliminated, and the pixel units can quickly release charges that remain after the LCD device is turned off. In this way, the LCD device may prevent after image from appearing. In this embodiment, one data line 2 may also be connected to the source electrode 302 of the TFT 300, while the short ring 1 may be connected to the drain electrode 303 of the TFT 300, and the above-mentioned effect also can be realized based on the same principle.

In the first embodiments of the present invention, a diode 102 for unilaterally conducting electricity to the short ring and a diode 101 for unilaterally conducting electricity to one data line 2 are disposed between the data line 2 and the short ring 1. Furthermore, the diodes 101 and 102 may be provided integrally by using a connection line.

Figure 2:
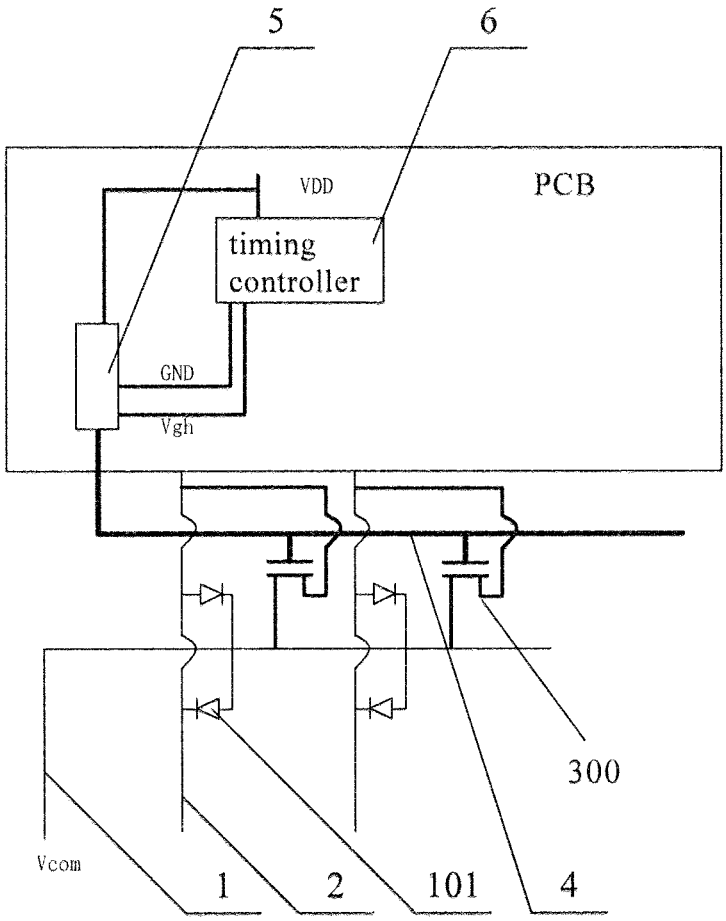
FIG. 2 is a schematic structural view of a second embodiment of the invention.

FIG. 2 is schematic structural view of a second embodiment of the present invention, and as shown in FIG. 2, a LCD device of the embodiment mainly comprises a short ring 1 that is supplied with a common voltage and a plurality of data lines 2. A TFT 300 is provided between each of the data lines 2 and the short ring 1 for transmitting the common voltage of the short ring 1 to the data line 2 when the LCD device is turned off. A gate electrode of the TFT 300 is connected to a compensating line 4 that is supplied with a high level signal when the LCD device is turned off, and a source electrode and a drain electrode of the TFT 300 is connected to the data line 2 and the short ring 1, respectively. With the above configuration, the high level signal is supplied to the compensating line from a print circuit board (PRB). For example, the PRB may have the following configuration: a VDD signal is input into a timing controller 6 and a power supply controller 5; the timing controller 6 respectively generates a GND signal and a Vgh signal in response to the VDD signal and transmits the signals to the power supply controller 5, and then the power supply controller 5 outputs the GND signal or the Vgh signal according to the state of the VDD signal, that is, outputs Vgh signal when the display device is turned off or outputs GND signal when the display device is not turned off.

In the second embodiment of the present invention, a power supply controller is disposed on a PRB and generates a high level signal in response to a signal source when the display device is turned off to turn on a TFT connected to the compensating line. In this way, the common voltage is supplied to the data lines so that the pixel electrodes of the respective pixel units are applied with the common voltage and at the same potential, and the residual signal that remains in the pixel unit when the display device is turned off can be quickly released. Therefore, the LCD device with high after image resistance ability can be realized.

Figure 3:
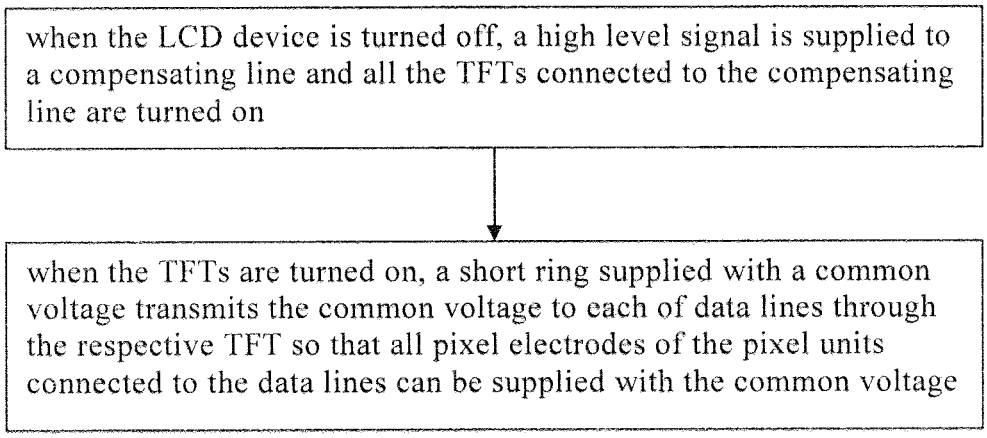
FIG. 3 is a schematic flowchart of a third embodiment of the invention.

FIG. 3 is a schematic flowchart of a third embodiment of the present invention. A method of driving a LCD device according to the embodiment may comprises the following steps:

when a turning-off signal is detected, a high level signal is supplied to a compensating line positioned in a non-display region through, for example, a print circuit board or pulse generating device, and all the TFTs, as switching devices, connected to the compensating line are turned on;

when the TFTs are turned on, a short ring supplied with a common voltage transmits the common voltage to each of data lines through the respective TFT so that all pixel electrodes of the pixel units connected to the data lines can be supplied with the common voltage and are at the same potential.

In the third embodiment of the present invention, by supplying a high level signal to the compensating line when the display device is turned off and turning on all the TFTs, as switching devices, connected to the compensating line, the common voltage applied to the short ring can be input to the data lines through the TFTs and further be input into the pixel electrodes of the pixel units, so that the pixel electrodes are at the same potential and the residual signal that remains in the pixel units when the display device is turned off can be released quickly, and thus the LCD device with a high after image resistance ability can be realized.

The method of the third embodiment of the present invention can be applied to any type of LCD devices with an active array.

The embodiment of the invention being thus described, it will be obvious that the same may be varied in many ways. Such variations are not to be regarded as a departure from the spirit and scope of the invention, and all such modifications as would be obvious to those skilled in the art are intended to be comprised within the scope of the following claims.

What is claimed is:

1. An array substrate of a liquid crystal display (LCD) device comprising a switching device switching a connection between a short ring connected with a common line and each of a plurality of data lines, and the short ring is supplied with a common voltage, wherein the switching device is turned off during a normal state, but is turned on by a control signal when the LCD device is turned off, thereby making potential of the data lines to be equal to that of the short ring, and wherein the switching device is a thin film transistor, and a gate electrode of the thin film transistor is connected to a compensating line which is supplied with a high level signal to turn on the thin film transistor when the display device is turned off.

2. The array substrate of the LCD device according to claim 1, wherein a drain electrode of the thin film transistor is connected to the short ring, and a source electrode of the thin film transistor is connected to the data line.

3. A method of driving an array substrate of a liquid crystal display (LCD) device, which comprises a short ring connected with a common line and a plurality of data lines, wherein a switching device is disposed between each of the data lines and the short ring and is controlled by a compensating line, and the switching line is supplied with a common voltage, the method comprising the step of:

supplying the compensating line with a high level signal to turn on the switching device when the LCD device is turned off, wherein, after the switching device are turned on, the short ring connected to the common line is electrically connected to the data lines, and potential of pixel electrodes of pixels connected to the data lines is made to be equal to that of the common line, wherein the switching device is a thin film transistor, and a gate electrode of the thin film transistor is connected to a compensating line which is supplied with a high level signal to turn on the thin film transistor when the display device is turned off.

4. The method according to claim 3, wherein a drain electrode of the thin film transistor is connected to the short ring and a source electrode of the thin film transistor is connected to the data line.

* * * * *